US012478113B2

(12) United States Patent
Drouin

(10) Patent No.: US 12,478,113 B2
(45) Date of Patent: Nov. 25, 2025

(54) VENTILATED LOWER BODY GARMENT

(71) Applicant: Inivex Composites Inc., Sherbrooke (CA)

(72) Inventor: Jean Drouin, Sherbrooke (CA)

( * ) Notice: Subject to any disclaimer, the term of this patent is extended or adjusted under 35 U.S.C. 154(b) by 0 days.

(21) Appl. No.: 18/737,804

(22) Filed: Jun. 7, 2024

(65) Prior Publication Data

US 2024/0407474 A1 Dec. 12, 2024

Related U.S. Application Data

(60) Provisional application No. 63/471,531, filed on Jun. 7, 2023.

(51) Int. Cl.
*A41B 9/00* (2006.01)
*A41B 9/02* (2006.01)

(52) U.S. Cl.
CPC ..... *A41B 9/004* (2013.01); *A41B 9/008* (2013.01); *A41B 9/02* (2013.01); *A41B 9/026* (2013.01)

(58) Field of Classification Search
CPC ..... A41B 9/004; A41B 9/008; A41B 9/02; A41B 9/026; A41D 1/08
See application file for complete search history.

(56) References Cited

U.S. PATENT DOCUMENTS

| | | | |
|---|---|---|---|
| 1,628,213 A | 5/1927 | Witz | |
| 2,050,410 A | 8/1936 | Baer | |
| 2,058,970 A | 10/1936 | Flesh | |
| 2,166,010 A | 7/1939 | La Maida | |
| 2,254,863 A | 9/1941 | Weihe | |
| 3,207,155 A | 9/1965 | Casey | |
| 5,239,706 A | 8/1993 | Stevenson | |
| 5,870,779 A | 2/1999 | Heron | |
| 6,308,342 B1 | 10/2001 | Qi | |
| 6,820,284 B2 | 11/2004 | Yasukawa | |
| 7,178,174 B2 | 2/2007 | Söderström | |
| 8,763,165 B2 | 7/2014 | Söderström | |
| 2003/0114782 A1 | 6/2003 | Chiang et al. | |
| 2004/0083537 A1 | 5/2004 | Mosha et al. | |
| 2006/0101558 A1 | 5/2006 | Coleman et al. | |
| 2007/0192941 A1 | 8/2007 | Söderström | |
| 2010/0163758 A1* | 7/2010 | Kirschenbaum | G21F 3/02 250/516.1 |
| 2013/0045651 A1 | 2/2013 | Esteves De Sousa Fangueiro et al. | |
| 2014/0026295 A1 | 1/2014 | McIntyre | |
| 2016/0286867 A1* | 10/2016 | Blibech | A41B 9/023 |
| 2021/0282469 A1* | 9/2021 | Siriwardena | A41B 9/12 |

(Continued)

FOREIGN PATENT DOCUMENTS

| | | |
|---|---|---|
| CA | 2028456 | 4/1992 |
| CN | 11057497 A | 12/2019 |
| WO | 2023009416 A1 | 2/2023 |

*Primary Examiner* — Khaled Annis
(74) *Attorney, Agent, or Firm* — Benoit & Côté Inc.; Danny Higgins

(57) ABSTRACT

A lower-body garment comprises a left leg portion, a right leg portion and an intermediate portion connecting the left leg portion to the right leg portion. The intermediate portion has a groin covering portion adapted to extend over a groin area of a wearer. The groin covering portion has a 3D textile. The 3D textile has at least one opening. In use, the opening of the 3D textile is stretched and compressed by a walking movement of the wearer thereby creating air movement.

14 Claims, 6 Drawing Sheets

(56) References Cited

U.S. PATENT DOCUMENTS

| | | | | |
|---|---|---|---|---|
| 2022/0096286 | A1 | 3/2022 | Kurt et al. | |
| 2023/0157376 | A1* | 5/2023 | Towns-Scott | A41B 9/005 2/406 |
| 2024/0407474 | A1* | 12/2024 | Drouin | A41D 27/28 |

* cited by examiner

VENTILATED LOWER BODY GARMENT

CROSS-REFERENCE TO RELATED APPLICATIONS

This application claims priority to U.S. Provisional Application No. 63/471,531 filed on Jun. 7, 2023, which is hereby incorporated by reference in its entirety.

FIELD OF THE INVENTION

The present invention generally relates to the field of clothing. More specifically, the invention relates to a lower body garment which improves comfort of the wearer by being ventilated.

BACKGROUND OF THE INVENTION

Lower-body garments are constantly evolving to provide added comfort and other benefits to their wearers. However, everyday lower-body garments may not be suitable for all activities or all wearers, especially during strenuous activities such as sports. Indeed, during such activities, the wearer moves a lot, ending up being very warm and sweating. For these occasions, a lower-body garment having improved ventilation is therefore beneficial.

SUMMARY OF THE INVENTION

It is an object of the present invention to provide a lower body garment that overcomes or mitigates one or more disadvantages of known lower body garments, or at least provides a useful alternative.

The invention provides the advantages of increasing the comfort of a wearer by having improved ventilation.

In accordance with an embodiment of the present invention, there is provided a lower-body garment comprising a left leg portion, a right leg portion and an intermediate portion connecting the left leg portion to the right leg portion. The intermediate portion has a groin covering portion adapted to extend over a groin area of a wearer. The groin covering portion has a 3D textile which has at least one opening. In use, the opening of the 3D textile is stretched and compressed by a walking movement of the wearer thereby creating air movement.

The intermediate portion may comprise a middle portion made of a 2D textile. The groin covering portion may comprise a left groin portion and a right groin portion whereas the middle portion may connect the left groin portion to the right groin portion.

The 3D textile of the groin portion may be sandwiched between an outer layer and an inner layer, the outer layer and the inner layer being made of a 2D textile permeable to air.

The 3D textile, the outer layer and the inner layer of each one of the left and right groin portions may be made of a single component.

The 3D textile may be made by one of 3D weaving, 3D knitting, 3D braiding or 3D printing. The 3D textile may be stretchable in all dimensions.

The 3D textile may comprise an XY plane in which two largest dimensions of the 3D textile extend, the opening extending substantially normal to the XY plane. The 3D textile may comprise a plurality of openings.

At least the left groin portion and the right groin portion may comprise silver on an inner side of the inner layer.

The lower-body garment may further comprise a waist portion connected to both the left and the right leg portions, as well as an adjusting system for adjusting tightness of the middle portion against the wearer. The adjusting system has a left adjuster connected to a left side of the intermediate portion proximate a left junction between the left groin portion and the middle portion and a right adjuster connected to a right side of the intermediate portion proximate a right junction between the right groin portion and the middle portion. The left and the right adjusters are attachable to the waist portion.

The lower-body garment may further comprise a left attachment point and a right attachment point located on the waist portion. The left adjuster and the right adjuster may be adjustable in length and may connect respectively to the left attachment point and the right attachment point through one of a push button, a hook and loop fastener or a hook and loop system.

The lower-body garment may further comprise a plurality of the left attachment point and a plurality of the right attachment point. Each one of the pluralities of the left attachment points and of the right attachment points may be disposed symmetrically along the waist portion on a respective side of a sagittal plane at a distance from each other.

The left adjuster and the right adjuster may each comprise a strap adjustable in length. The left leg portion, the right leg portion and the intermediate portion may be stretchable so as to tightly fit the wearer.

The lower-body garment may be one of pants, yoga pants, leggings, shorts, cycling shorts, or underwear such as briefs, shorts, boxers, panties or pantyhose.

BRIEF DESCRIPTION OF DRAWINGS

These and other features of the present invention will become more apparent from the following description in which reference is made to the appended drawings wherein.

DETAILED DESCRIPTION OF THE INVENTION

The present invention relates to a tight-fitting lower-body garment, such as pants, yoga pants, leggings, shorts, cycling shorts, or tight-fitting lower-body underwear such as briefs, shorts, boxers, panties, pantyhose, etc.

Figure 1:
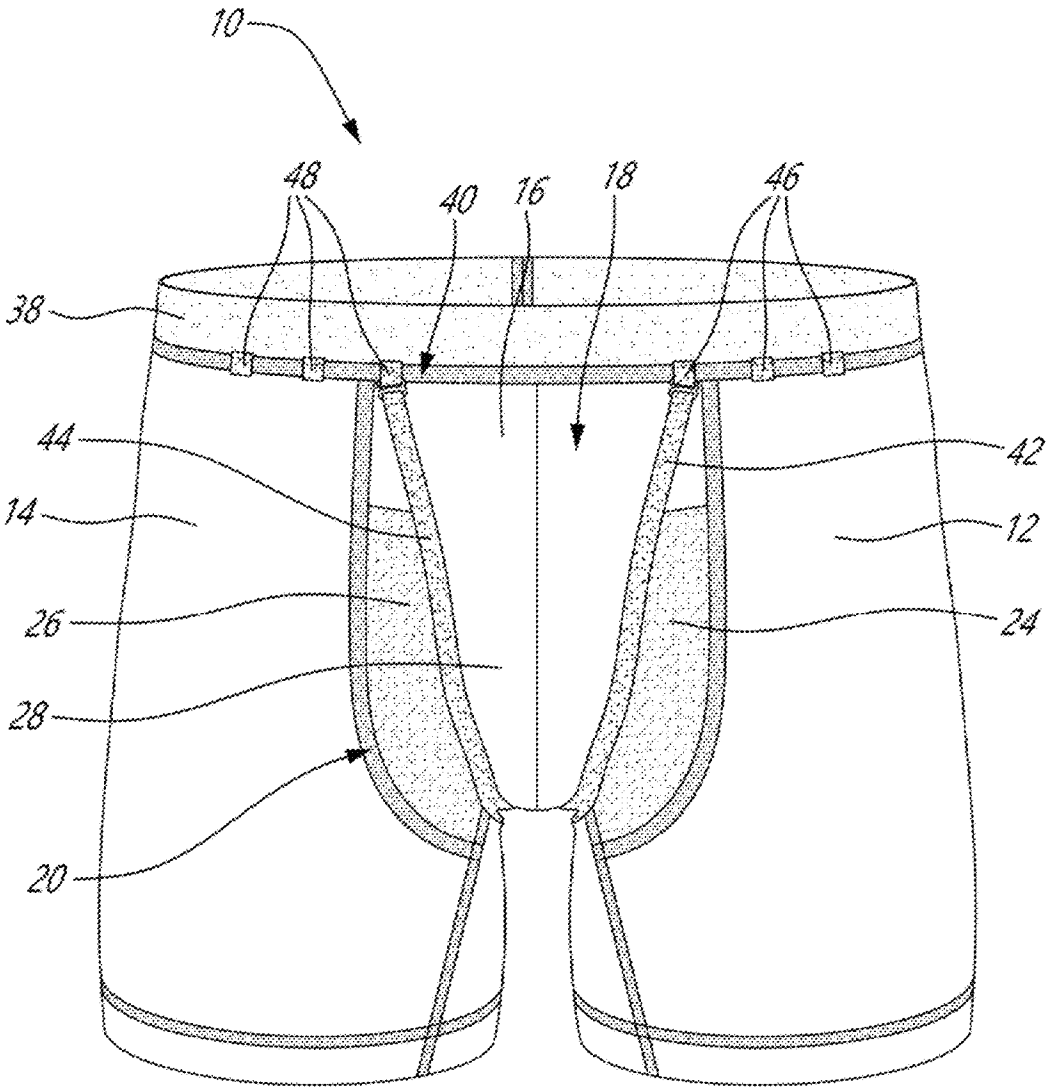
FIG. 1 is a front view of a lower-body garment in accordance with an embodiment of the present invention.
Figure 2:
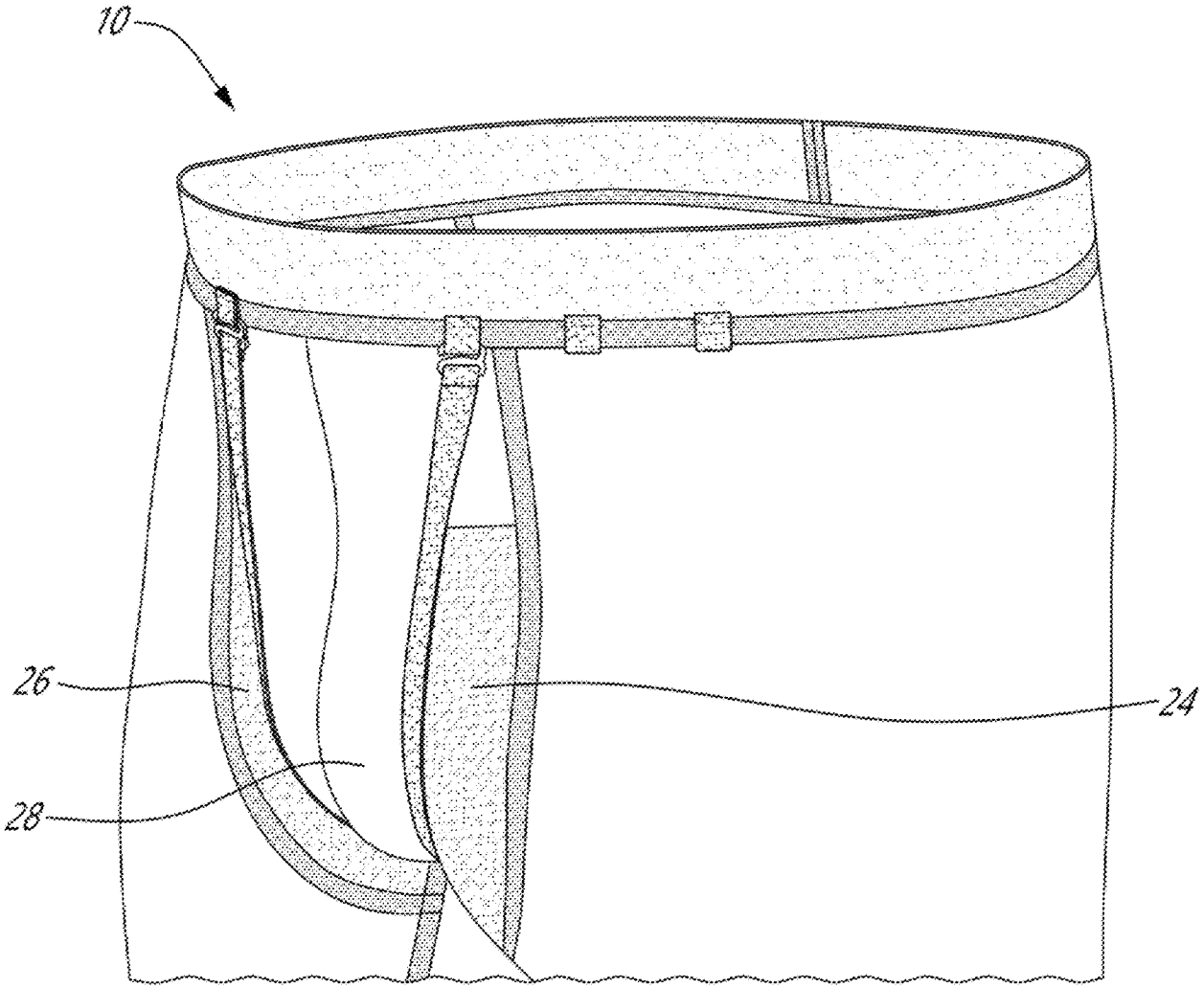
FIG. 2 is a perspective view from the left of the lower-body garment of FIG. 1.

FIGS. 1 and 2 are referred to. A lower-body garment 10 comprises a left leg portion 12, a right leg portion 14 and an intermediate portion 16. The left and right leg portions 12, 14 are adapted to fit their respective left and right leg, or left and right thigh, of a wearer if the garment is of the short type. The intermediate portion 16 connects the left leg portion 12 to the right leg portion 14 at a front area 18 of the garment 10.

Both left and right leg portions 12, 14 may be made of any type of 2D textile or fabric, preferably stretchable so as to closely fit a body of the wearer.

Figures 3A, 3B, 3C:
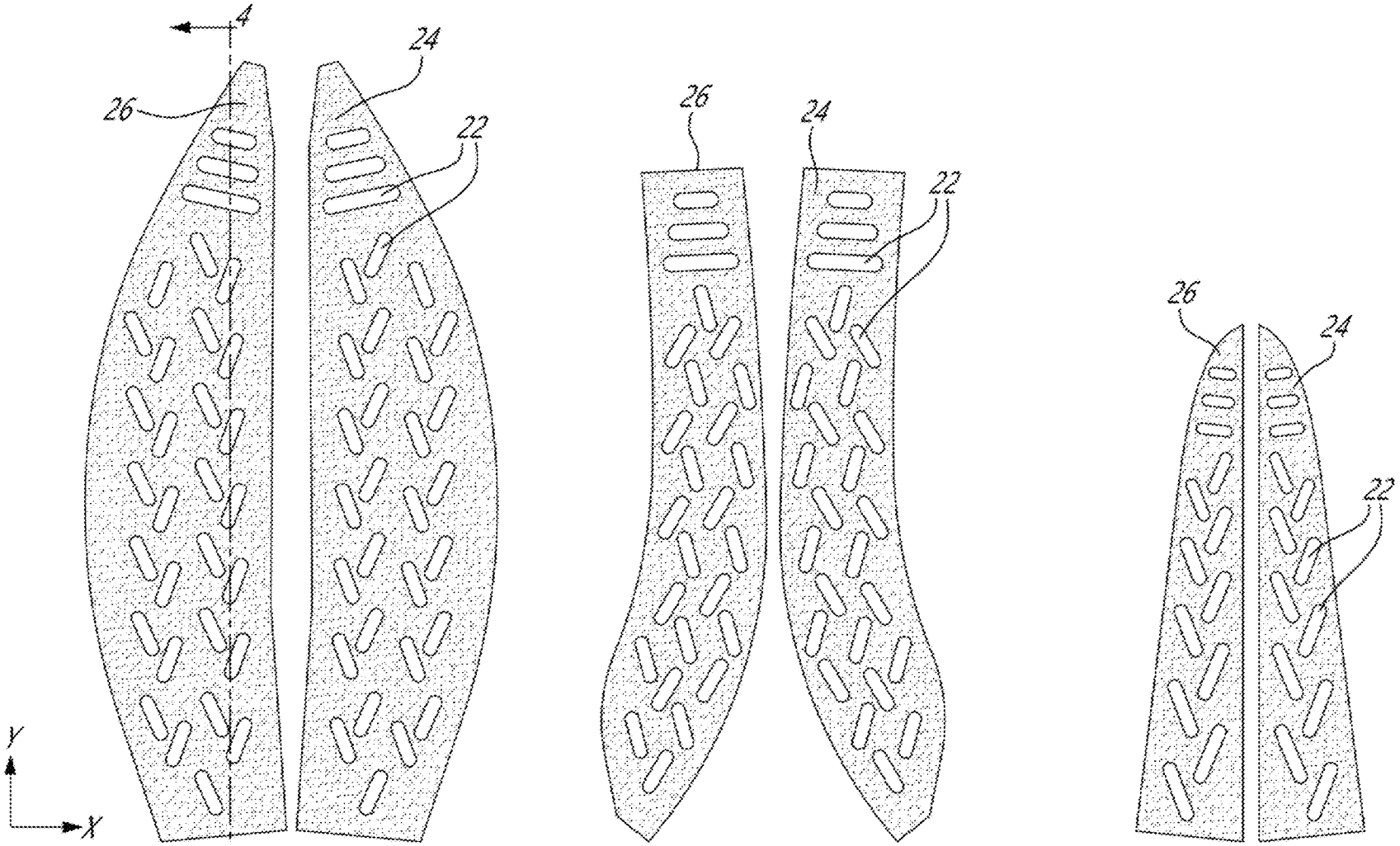
FIGS. 3*a*-3*c* are top views of pairs of left and right groin portions of the lower-body garment of FIG. 1 of different combinations of size and gender, where inner and outer layers are removed to expose openings of a 3D textile.

The intermediate portion 16 has a groin covering portion 20 adapted to extend over a groin area of a wearer. The groin covering portion 20 uses a 3D textile to cover at least partly a groin area of the user. Such 3D textiles are weaved, knitted or braided three-dimensionally, that is also in a Z direction, to provide a considerable thickness to the 3D textile. The 3D textile used in the groin covering portion 20 comprises at least one, and preferably a plurality, of apertures, porosities, cavities or openings 22. This is best shown in FIGS. 3*a* to 3*c* and in FIG. 4, now concurrently referred to. These openings 22 are typically oriented in the Z direction (thickness), although other orientations are also possible. The openings 22 are used to let air flow through and reach a groin area of the wearer. The 3D textile 30 used in the groin covering portion 20 is also preferably stretchable to as to closely fit the body of the wearer.

Figure 5:
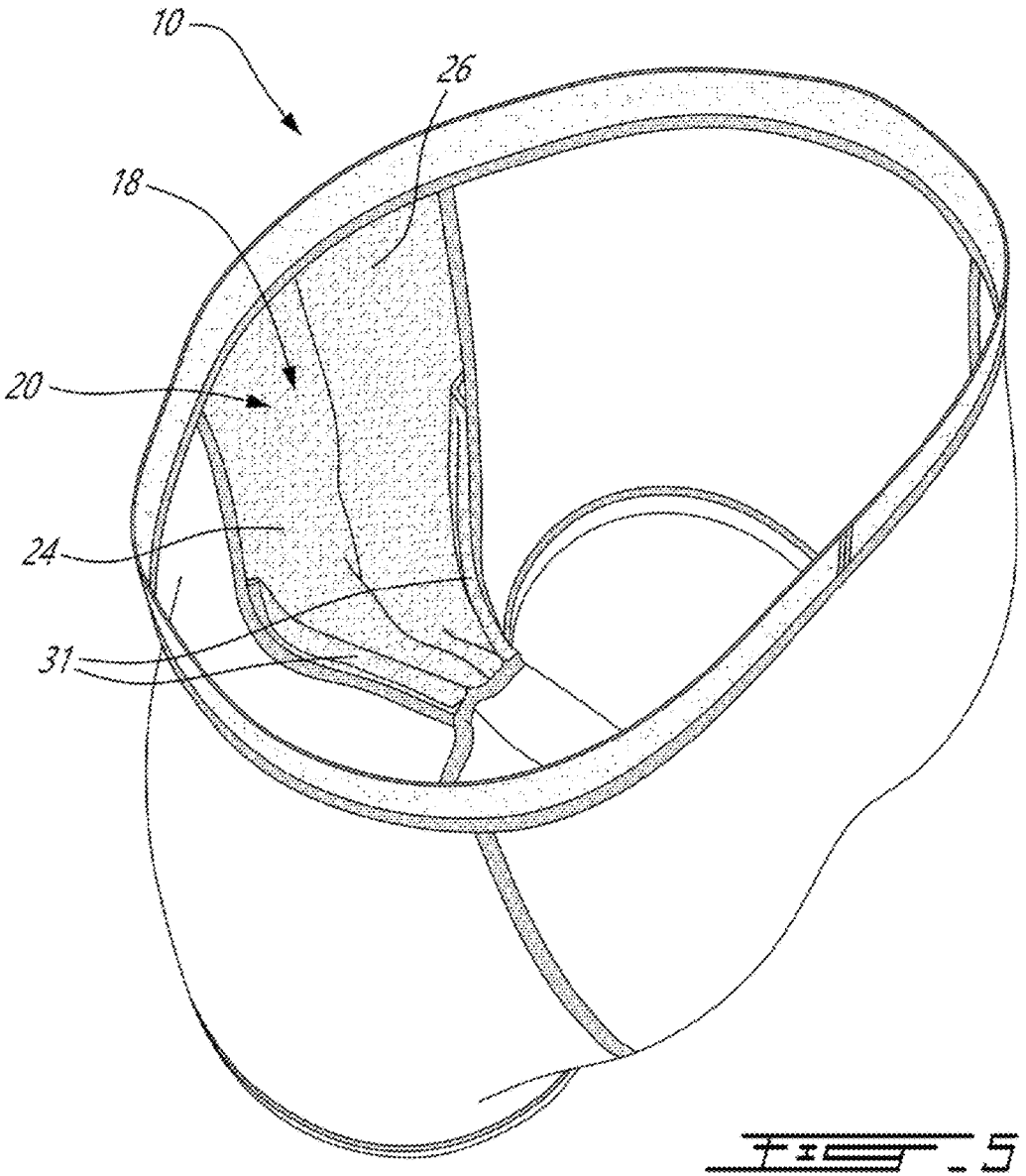
FIG. 5 is a view of another a lower-body garment in accordance with another embodiment of the present invention.

The groin covering portion 20 may be made of a single piece of 3D textile covering both a left groin portion 24 and a right groin portion 26 and extending there in between, or it may be made of two or more pieces, such as depicted in the embodiment of FIG. 5. FIG. 5 depicts an embodiment of the lower-body garment 10 where both the left groin portion 24 and the right groin portion 26 extend sufficiently to connect together and cover the whole groin covering portion 20 so that the middle portion 28 is basically non-existent.

Optionally, the lower-body garment 10 may use separators 31 for better isolating the skin of a scrotum and a penis of the wearer from rubbing on his legs. The separator may incorporate 3D textile or not. The separators 31 may extend in an arcuate profile up to the groin area. These separators 31 may be present in an embodiment of the lower-body garment 10 or not.

Alternatively, the left groin portion 24 and the right groin portion 26 may be restricted in size locally over their respective groin area, typically for cost reasons. In this case, the left groin portion 24 and the right groin portion 26 are interconnected by a middle portion 28 which is typically made of a 2D textile.

Figure 4:
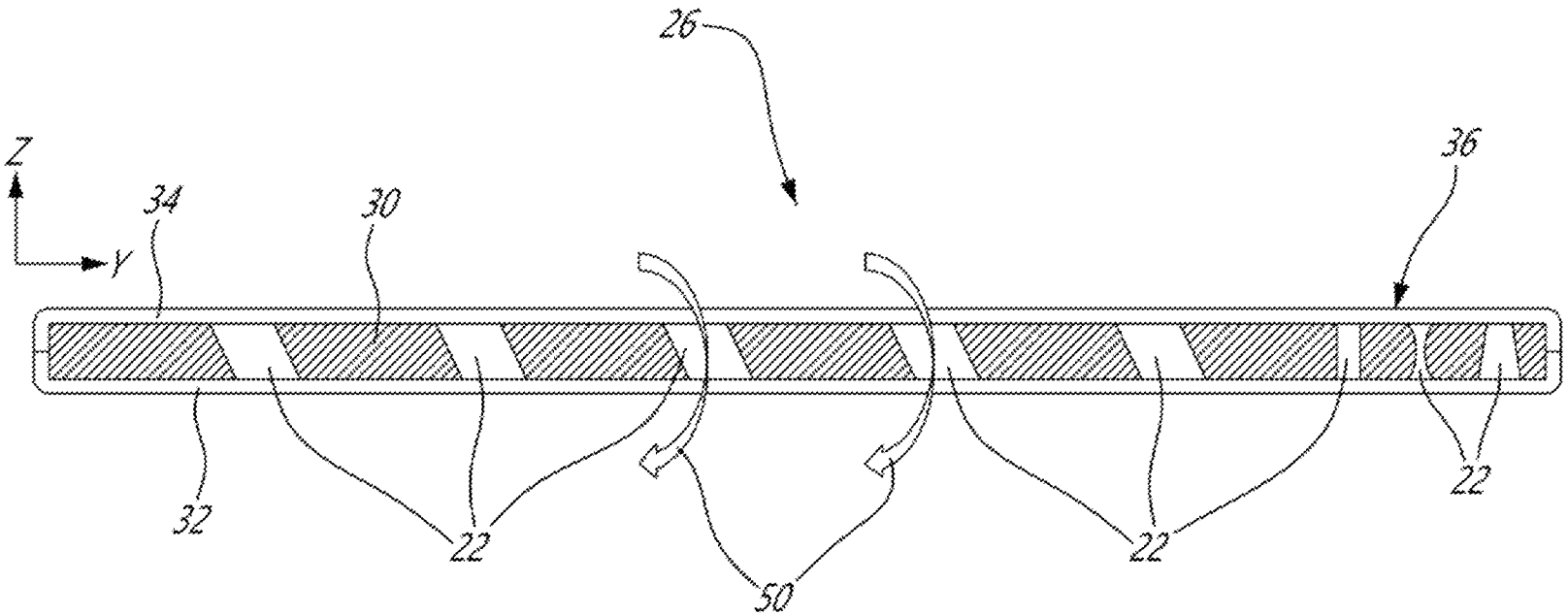
FIG. 4 is a cross-sectional view of the left groin portion of FIG. 2*a* where the inner and outer layers are shown.

The 3D textile 30 is made by one of 3D weaving, 3D knitting, 3D braiding or 3D printing. This 3D textile 30 is stretchable in all dimensions. The 3D textile 30 of the groin portion 20, and especially that of both the left groin portion 24 and the right groin portion 26, is sandwiched between an outer layer 32 and an inner layer 34. The outer layer 32 and the inner layer 34 are made of a 2D textile permeable to air. FIG. 4 shows a cross-section of the right groin portion 26 shown in FIG. 3*a*, where the outer layer 32 and the inner layer 34 are clearly seen surrounding the 3D textile 30. Edges of the outer layer 32 may be sown, glued, or heat welded to those of the inner layer 34, thereby encapsulating and protecting the 3D textile 30 into a sub-component which may be integrated into the garment 10. The apertures or openings 22 are clearly shown in FIG. 4, where some of the openings 22 extend through the 3D textile 30 at a normal angle with a reference plane, or surface 36 of the assembled sub-component (this plane being referenced as the XY plane aligned with the two largest dimensions of the 3D textile as shown in FIG. 3*a*). In the present case, the sub-component shown is the right groin portion 26, but the sub-component could also be the left groin portion 24.

The openings 22 may take different shapes, both in the XY plane, in an XZ plane or in a YZ plane, all planes being perpendicular to one another. For example, as shown in FIGS. 3*a* and 4, the openings 22 may have circular or elongated shapes in the XY plane while having a parallelepiped, a rectangular, a frusto-conical, a venturi (hourglass) cross-section in the YZ plane.

In order to provide improved antibacterial or fungicidal benefits, the groin portion 20, and especially the left and right groin portions 24, 26 may be made of a textile using a fiber made of, treated with or coated with silver. In particular, this fiber may be used in the fabric of the inner layer 34, especially on its inner face that is in contact with the skin of the wearer.

Figure 6:
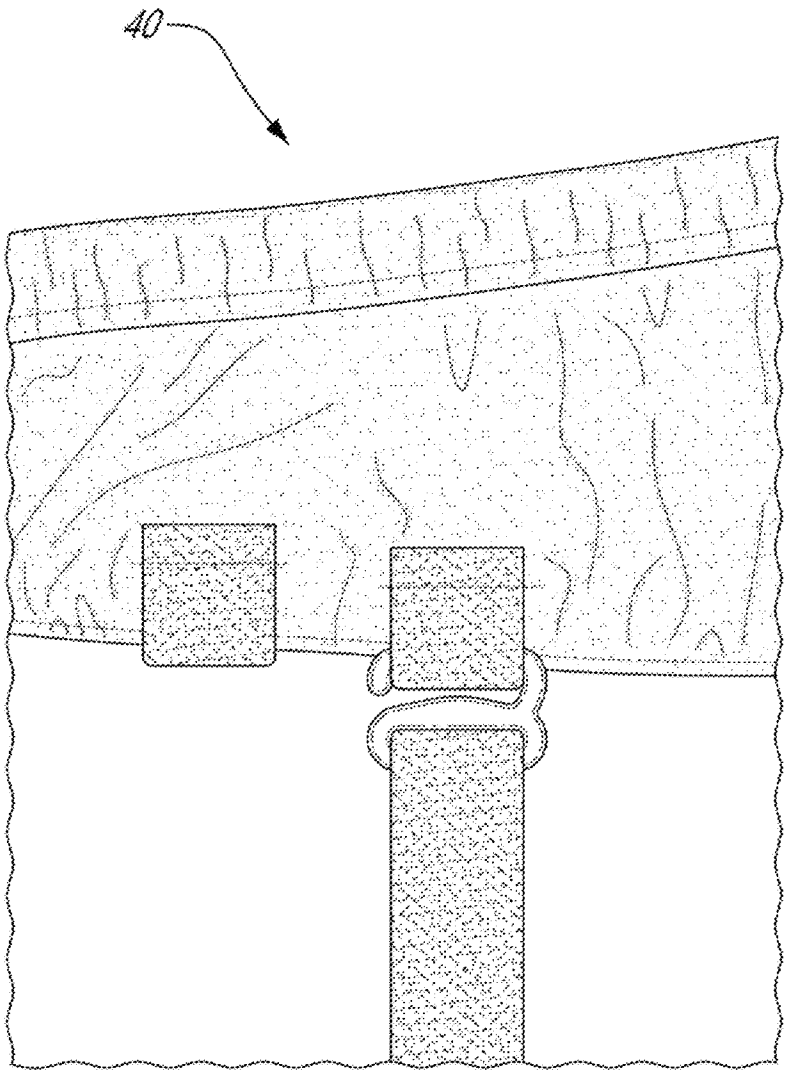
FIG. 6 is a detailed view of an adjusting system of the lower-body garment of FIG. 1.

The lower-body garment 10 also comprise a waist portion 38 connected to both the left and the right leg portions 24, 26. FIG. 6 is now concurrently referred to. In another embodiment, adjusting system 40 is provided for adjusting a tightness of the middle portion 28 against the wearer. This is especially relevant to male wearers who may benefit from added support of the male genitalia. The adjusting system 40 comprises a left adjuster 42 connected on a left side of the intermediate portion 16, proximate a left junction between the left groin portion 24 and the middle portion 28, and a right adjuster 44 connected to a right side of the intermediate portion 16 proximate a right junction between the right groin portion 26 and the middle portion 28. At their respective extremity, both the left and the right adjusters 42, 44 are connected to the waist portion 38 through respective left and right attachment points 46, 48. At least one left attachment point 46 and at least one right attachment point 48 are disposed on the waist portion 38, symmetrically on each side of a sagittal plane. The left and right attachment points 46, 48 are placed along the waist portion 38 at increasing distances from the sagittal plane. The left adjuster 42 and the right adjuster 44 are designed to attach respectively to one of the left attachment points 46 and the right attachment points 48. Both the left adjuster 42 and the right adjuster 44 may be made of a strap which may be adjustable in length. The adjustability in length of the left and right adjusters 42, 44 and the choice of the distance from the sagittal plane where the left and right adjusters 42, 44 are attached to their respective one of the left and the right attachment points 46, 48 allows adaptability of the fit of the lower-body garment 10 to the anatomy of each wearer. The adjustability in length of both the left and right adjusters 42, 44 may also, or additionally, be provided with an elastic portion in both adjusters.

The left and right adjusters 42, 44 may attach to their respective left and right attachment points 46, 48 through one of the many attachment options known in the art, such as buttons, press buttons, a hook and loop system (such as depicted in FIG. 5), a hook and loop fastener (Velcro™), etc.

The fabrics used in the construction of the lower-body garment 10 may be made of many types of fiber, such as natural textile fiber such as cotton, silk, wool, hemp, jute, flax/linen, cashmere, mohair, alpaca, angora, ramie, and coconut, or manmade textile fibers such as polyester, nylon, rayon, acrylic, spandex/elastane, olefin/polypropylene, Modal™, Lyocell™, viscose, bamboo rayon, carbon fiber, and aramid fiber. Fabrics that are comfortable against the skin and that are stretchable in order to closely fit the body of the wearer are preferred. To that extent, fibers may be mixed to achieve the desired result. For example, a mix of polyester and spandex may be used for the 2D textile or 3D textile. For the 3D textile, the Neo Matrix™ from Maca-Sports™ is known to perform adequately.

In use, the wearer will wear the lower-body garment 10 in a tightly fitting fashion. This ensures that the lower-body garment 10 closely follows the movements of the wearer's body, and especially of his/her legs. Indeed, as the wearer's legs move, for example during walking, running, cycling or in any other way, the groin portion 20, and more particularly the left groin portion 24 and the right groin portion 26 having the 3D textile 30 get cyclically stretched and compressed. This alternate cycle of stretching and compressing also applies to the openings 22 of the 3D textile 30 which then act as small pumps, pumping air in and out of the lower body garment 10 and thereby creating a beneficial air flow 50 circulation in the wearer's groin area. This benefits in evacuating moisture during intense activity, improving the wearer's comfort and potentially also preventing irritation in the wearer's groin area.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

What is claimed is:

1. A lower-body garment comprising:

a left leg portion;

a right leg portion; and an intermediate portion connecting the left leg portion to the right leg portion, the intermediate portion having a groin covering portion adapted to extend over a groin area of a wearer, the groin covering portion having a 3D textile, the 3D textile having at least one opening, whereas in use, the opening of the 3D textile is stretched and compressed by a walking movement of the wearer thereby creating air movement.

2. The lower-body garment of claim 1, wherein the intermediate portion comprises a middle portion made of a 2D textile and wherein the groin covering portion comprises a left groin portion and a right groin portion, the middle portion connecting the left groin portion to the right groin portion.

3. The lower-body garment of claim 2, wherein at least the left groin portion and the right groin portion further comprise silver on an inner side of an inner layer.

4. The lower-body garment of claim 2, further comprising: a waist portion connected to both the left and the right leg portions; and an adjusting system for adjusting a tightness of the middle portion against the wearer, the adjusting system having:

a left adjuster connected to a left side of the intermediate portion proximate a left junction between the left groin portion and the middle portion; and a right adjuster connected to a right side of the intermediate portion proximate a right junction between the right groin portion and the middle portion, wherein the left and the right adjusters are attachable to the waist portion.

5. The lower-body garment of claim 4, further comprising a left attachment point and a right attachment point located on the waist portion, the left adjuster and the right adjuster being adjustable in length and connecting respectively to the left attachment point and the right attachment point through one of a push button, a hook and loop fastener or a hook and loop system.

6. The lower-body garment of claim 5, comprising a plurality of the left attachment point and a plurality of the right attachment point, each one of the pluralities of the left attachment points and of the right attachment points being disposed symmetrically along the waist portion on a respective side of a sagittal plane at a distance from each other.

7. The lower-body garment of claim 4, wherein the left adjuster and the right adjuster each comprise a strap adjustable in length.

8. The lower-body garment of claim 2, wherein the 3D textile, the outer layer and the inner layer of each one of the left and right groin portions are made of a single component.

9. The lower-body garment of claim 1, wherein the 3D textile of the groin portion is sandwiched between an outer layer and an inner layer, the outer layer and the inner layer being made of a 2D textile permeable to air.

10. The lower-body garment of claim 1, wherein the 3D textile is made by one of 3D weaving, 3D knitting, 3D braiding or 3D printing.

11. The lower-body garment of claim 1, wherein the 3D textile is stretchable in all dimensions.

12. The lower-body garment of claim 1, wherein the 3D textile comprises an XY plane in which two largest dimensions of the 3D textile extend, the opening extending substantially normal to the XY plane.

13. The lower-body garment of claim 1, wherein the left leg portion, the right leg portion and the intermediate portion are stretchable so as to tightly fit the wearer.

14. The lower-body garment of claim 1, wherein the lower-body garment is one of pants, yoga pants, leggings, shorts, cycling shorts, or underwear such as briefs, shorts, boxers, panties or pantyhose.

* * * * *